US005255394A

United States Patent [19]

Long

[11] Patent Number: 5,255,394

[45] Date of Patent: Oct. 26, 1993

[54] OVERHEAD LOAD HOLDING HELMET

[75] Inventor: James L. Long, Minneapolis, Minn.

[73] Assignee: R. Eugene Goick, Excelsior, Minn. ; a part interest

[21] Appl. No.: 976,273

[22] Filed: Nov. 13, 1992

[51] Int. Cl.[5] ..... A42B 3/04

[52] U.S. Cl. ..... 2/410; 224/181

[58] Field of Search ..... 2/7, 171.1, 185 R, 199, 2/209.1, 410; 224/181, 182, 185, 186

[56] References Cited

U.S. PATENT DOCUMENTS

| | | | |
|---|---|---|---|
| 3,028,059 | 4/1962 | Greenwood | 224/181 |
| 3,229,872 | 1/1966 | Williams | 2/199 |
| 3,722,764 | 3/1973 | Kallander | 224/181 |
| 3,800,989 | 4/1974 | Kallander | 224/181 |
| 4,649,846 | 3/1987 | Javanelle | 224/181 |
| 5,050,245 | 9/1991 | Nearhood | 2/410 |
| 5,070,546 | 12/1991 | Stazo | 2/199 |

FOREIGN PATENT DOCUMENTS

| | | | |
|---|---|---|---|
| 1238497 | 7/1960 | France | 2/7 |

*Primary Examiner*—Clifford D. Crowder
*Assistant Examiner*—Diana L. Biefeld
*Attorney, Agent, or Firm*—Palmatier, Sjoquist & Helget

[57] ABSTRACT

A device for supporting an overhead load such as a drywall panel in an overhead location, consisting of a helmet including a hard hat and a rotatable flat turntable supported from the hard hat. In one form, a base for the rotatable turntable is demountable supported on the hard hat, and in the alternate form, the bearing for supporting the turntable is formed integrally of the hard hat.

7 Claims, 2 Drawing Sheets

OVERHEAD LOAD HOLDING HELMET

This invention relates to a device for assisting in supporting drywall panels during the installation thereof in overhead locations.

BACKGROUND OF THE INVENTION

Overhead loads take many forms. Commonly such loads comprise drywall panels are often considered to be synonymous with sheetrock panels, the terminology may also be applied to panels made of wood or plywood, sheet metal, and other manufactured panels used in building construction. The installation of such drywall panels in overhead locations, such as in ceilings, presents some difficult problems because the panels are large in size and oftentimes heavy in weight. For instance, sheetrock panels may be ten feet long by four feet wide, or larger, and one-half inch in thickness, or thicker.

It has been common practice with some tradesmen to lift the panel approximately into place and then by using their heads to support the panel in its proper location, they will nail the panel into an overhead joist so as to secure it. Quite obviously, this technique is difficult to employ and does present hazardous safety problems, particularly inasmuch as such workmen oftentimes need to stand on scaffolding.

SUMMARY OF THE INVENTION

An object of the invention is to provide a new and improved device to provide support to a drywall panel from a workman's head when the panel is being installed in an overhead location.

A feature of the invention is the provision of a substantially rigid helmet to be worn by a workman on his head, and a rotatable turntable rotatably supported on the helmet and carrying the drywall panel. The panel may be lifted into place by the turntable supported on the helmet, and the workman may turn his head and body as he positions the drywall panel into its proper place and as he is initially pounding nails into the panel for securing the panel to the overhead joist. The helmet may take different forms as to directly receive the workman's head, or in another form, may simply receive the upper portion of a conventional safety helmet.

The panel engaging turntable may have a rubber or cushioning cover on it which engages the drywall panel as to minimize the possibility of damaging the panel and as to create a frictional relation with the turntable so that tho panel may be more feasibly maneuvered while minimizing the likelihood of slipping between the turntable and the panel.

Quite obviously, this device minimizes the likelihood of injury to the workman and will allow him to use this technique of supporting the panel with his head for longer periods without causing soreness or injury to the workman's head.

DETAILED SPECIFICATION

Figure 1:
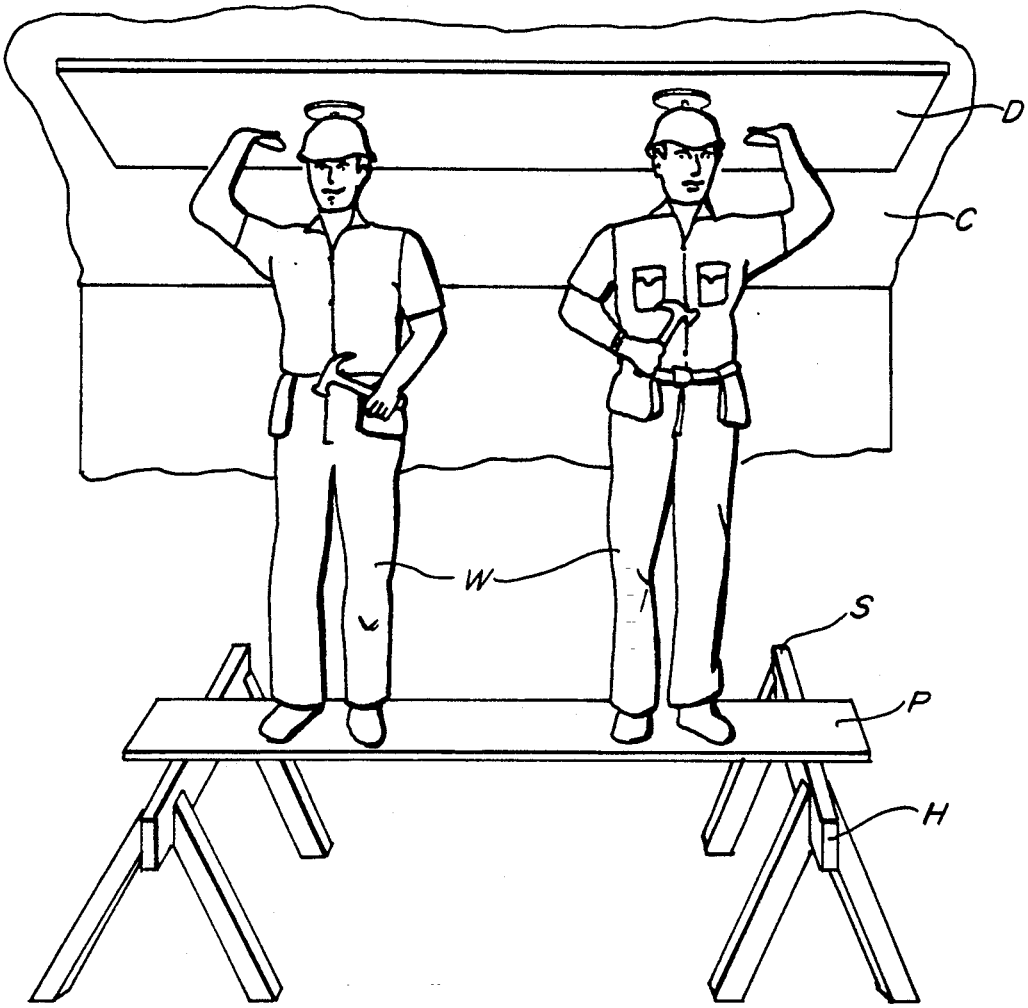
FIG. 1 is a diagrammatic view showing the present invention in use.

As seen in FIG. 1, the workmen W are supporting a drywall panel D in an overhead location as for the purpose of completing a ceiling C in the construction of a building. In this instance, the workmen are standing on a form of scaffolding S comprising a simple plank P extending across a pair of sawhorses H. It is commonplace that as the workmen hold the drywall panel in this overhead position, they will commence tacking or nailing the panel in its permanent location. Accordingly, such workmen prefer to have both hands free, and they will support the drywall panel from their heads. Of course, the workmen like to be able to turn relative to the panel, or they may like to turn the panel relative to their heads so as to properly position the panel in the ceiling.

Figure 2:
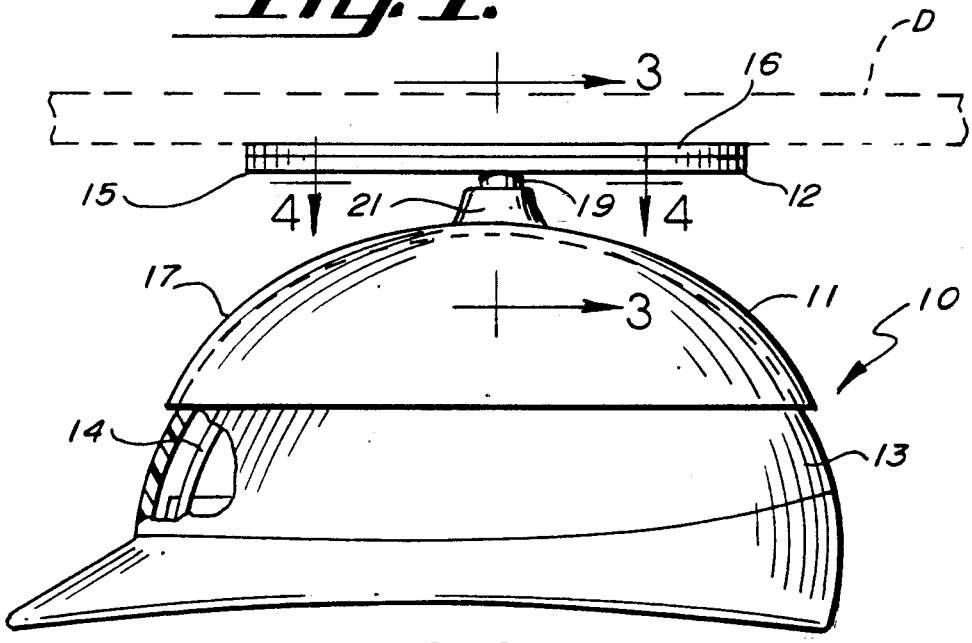
FIG. 2 is an elevation view of one form of the invention shown applied to a conventional safety helmet commonly used by workmen in the construction trades.
Figure 3:
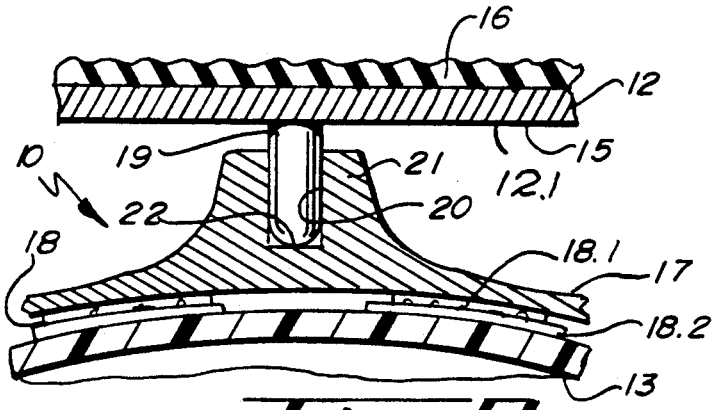
FIG. 3 is an enlarged detail section view taken approximately at 3—3 in FIG. 2.
Figure 4:
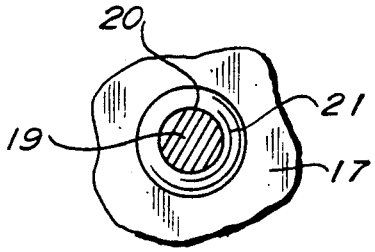
FIG. 4 is a detail section view taken approximately at 4—4 in FIG. 2.
Figure 5:
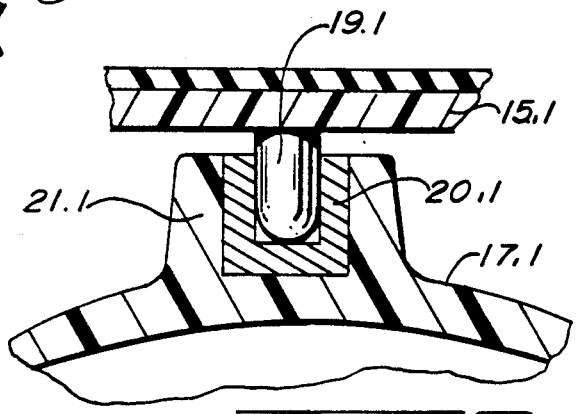
FIG. 5 is a detail section view showing a modified form of the invention as compared to that illustrated in FIG. 3.
Figure 6:
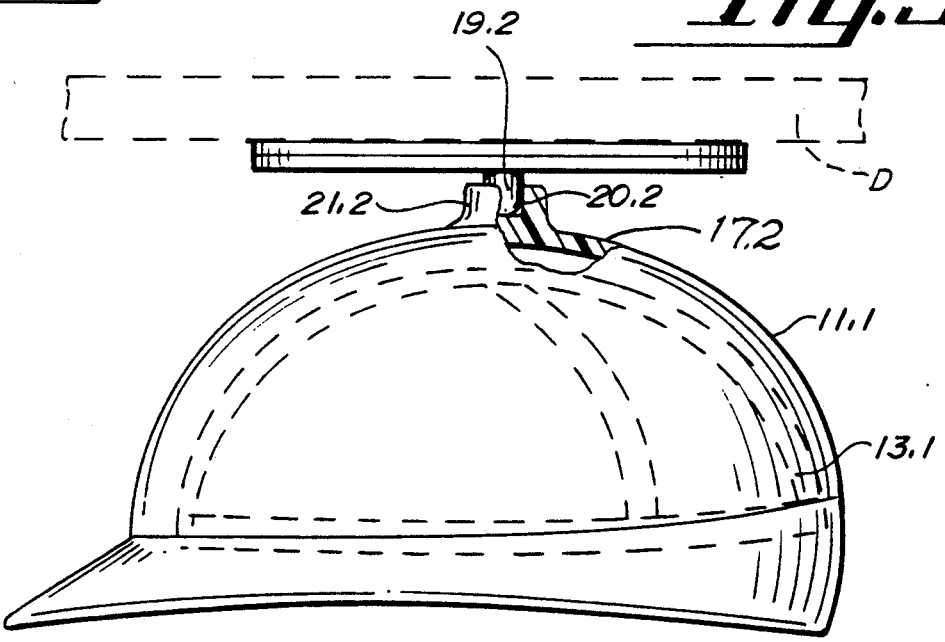
FIG. 6 is an elevation view, partly broken away for clarity of detail, and illustrating a modified form of the invention.

The preferred form of device is indicated in general by numeral 10, is illustrated, in its preferred form in FIGS. 2–4, and a principal alternate form is illustrated in FIG. 6, and a modified form of bearing is illustrating in FIG. 5.

The drywall supporting device 10 comprises a helmet portion indicated in general by numeral 11, and a turntable portion 12.

The helmet portion, as illustrated in FIG. 2, includes a hard hat 13 of the type which is well-known and which is commonly worn by workmen in a construction facility, primarily to avoid head injuries. The hard hat 13 is generally dome-shaped, and is shaped to generally conform to the shape of a workman's head, and additionally, the hard hat incorporates internal webbing 14 which actually engages the workmen's head so that the hard hat 13 is worn with a certain amount of comfort. The hard hat 13 is made of molded plastic in many cases, although it may be made of metal. Such a hard hat is typically made of a polycarbonate, which is extremely hard and durable.

The turntable 12 is substantially flat and circular and incorporates a rigid panel 15 which is preferably formed of rigid plastic, but could be formed of metal also. The panel 15 is typically formed of a polycarbonate for hardness. The upper face of the turntable 12 has a cushioned layer 16 which may be formed of rubber or rubber-like material, or any of a number of softly resilient plastics which add a frictional relation between the turntable 12 and the drywall panel D, as to minimize the likelihood of slipping between the panel and the turntable. Furthermore, the padding in the upper layer 16 will minimize the likelihood of any scratching of the surface of the drywall by the turntable 12.

In the preferred form as illustrated in FIGS. 2–4, the helmet 10 includes a rigid base portion or upper 17 molded of substantially rigid plastic, such as polycarbonate, and shaped to be dome-shaped and to thereby conform substantially to the shape of the hard hat 13. The base portion 17 is provided with anchoring means 18 preferably a double face adhesive tape manufactured by 3M Company of St. Paul, Minn. for demountably securing the base portion 17 to the hard hat 13. In the form illustrated, the anchoring means 18 comprises hook and loop portions 18.1 and 18.2, respectively, formed on fabric-type material adhesively adhered to the confronting surfaces of the hard hat 13 and the base portion 17. Such hook and loop portions 18.1, 18.2 are commonly known by their trademark Velcro and serve to hold the base portion 17 and the turntable portion 12 in stationary relationship to the hard hat 13 while allowing the turntable to rotate; and when the hard hat 13 is to be used without the base portion 17 and turntable 12, the base portion 17 may be removed by simply pulling it off.

Rotatable thrust bearing portions 19, 20 are provided on the lower side 12.1 of the turntable 12 and helmet 11 respectively, and more specifically, the bearing 20 is a part of the demountable base portion 17. The bearing portion 19 comprises a cylindrical pin or stub shaft, and the circular bearing 20 is formed in a boss 21 formed integrally of the base portion 17. A bottom surface 22 accepts the downward thrust from the end of the rotatable pin 19 to carry the weight of the drywall panel D and the turntable 12 to the base portion and hard hat 13.

In the alternate form of FIG. 5, a bearing cup 20.1 is embedded in the stationary boss 21.1, which is formed integrally of the base portion 17.1. As in the form illustrated in FIGS. 1–3, the rotatable pin 19.1 (like pin 19) is affixed into the stationary boss with the turntable panel 15.1.

In the alternate form illustrated in FIG. 6, the helmet 11.1 is formed in one piece, whereby the hard hat 13.1 has the boss 21.2 formed integrally thereof in upper portion 17.2 as to define the thrust receiving bearing 20.2 to receive the rotary insert pin 19.2 therein. In this form, the boss 21.2 is a part of the hard hat 13.1, whereas in the form of FIGS. 2–4, the base portion 17, with the boss 21, receiving the bearing pin 19, is removable from the hard hat 13.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. A device for supporting an overhead load in an overhead location from a workman's head, comprising a helmet portion to be supported upon a workman's head and comprising a substantially rigid hard hat with a substantially dome-shaped interior and to be carried upon the workman's head, the helmet portion comprising an upper portion with a first rotary thrust bearing portion thereon, and a turntable portion rotatably supported on the helmet portion, the turntable portion comprising an upper face and being substantially horizontally oriented to engage and support such an overhead load, the turntable portion comprising a lower portion facing the upper portion of the helmet portion and said lower portion also having a second rotary thrust bearing portion thereon, one of said first and second thrust bearing portions comprising an insert pin and the other of said first and second thrust bearing portions comprising a socket bearing portion, said insert pin being received in said socket bearing portion to permit the turntable portion and overhead load to be turned while the helmet portion and workman's head remain stationary, and to also permit the workman's head to be turned while the turntable portion and the overhead load remain stationary.

2. A supporting device according to claim 1 wherein the upper portion of the helmet portion comprises a demountable base portion carried on the hard hat.

3. A supporting device according to claim 2 wherein the hard hat and base portion have cooperative anchoring means for retaining the base portion on the hard hat.

4. A supporting device according to claim 3 wherein said anchoring means comprises flexible hook and loop portions confronting each other and adhered to the hard hat and base portions.

5. A supporting device according to claim 1 wherein the second rotary thrust bearing portion on the lower portion of the turntable portion comprises said circular socket portion, and said first rotary thrust bearing portion on said helmet portion comprises said insert pin.

6. A device for supporting an overhead load in an overhead location from a workman's head, comprising a helmet portion to be supported upon a workman's head and comprising a substantially rigid hard hat with a substantially dome-shaped exterior and to be carried upon the workman's head, the helmet portion comprising an upwardly opening socket bearing portion, and a turntable portion comprising a padded upper face to engage and support such an overhead load, the turntable portion also having a depending bearing insert pin rotatably received in said socket portion to permit the turntable portion and overhead load to be turned while the helmet portion and workman's head remains stationary, and to also permit the workman's head to be turned while the turntable and overhead load remain stationary.

7. A supporting device according to claim 6 wherein said helmet portion also comprises a generally dome-shaped base portion conforming to the shape of said hard hat and lying thereon, and means anchoring the base portion to the hard hat portion.

* * * * *